US012782057B2

(12) United States Patent
Shih

(10) Patent No.: US 12,782,057 B2
(45) Date of Patent: Nov. 3, 2026

(54) RADIATOR WITH TUBE MODULARIZED DEVICE

(71) Applicant: Po-Wen Shih, Taichung City (TW)

(72) Inventor: Po-Wen Shih, Taichung City (TW)

( * ) Notice: Subject to any disclaimer, the term of this patent is extended or adjusted under 35 U.S.C. 154(b) by 107 days.

(21) Appl. No.: 19/016,231

(22) Filed: Jan. 10, 2025

(65) Prior Publication Data

US 2026/0202135 A1 Jul. 16, 2026

(51) Int. Cl.
*F28D 1/053* (2006.01)
*F28F 1/12* (2006.01)
*F28F 9/02* (2006.01)

(52) U.S. Cl.
CPC ..... *F28D 1/05366* (2013.01); *F28D 1/05383* (2013.01); *F28F 1/126* (2013.01); *F28F 9/0246* (2013.01)

(58) Field of Classification Search
CPC .. F28D 1/05366; F28D 1/05383; F28F 1/126; F28F 9/0246
USPC ..... 165/148
See application file for complete search history.

(56) References Cited

U.S. PATENT DOCUMENTS 5,251,694 A * 10/1993 Chigira ..... F28F 9/0224 165/173
9,470,461 B2 * 10/2016 Merklein ..... F28F 9/0226
9,777,973 B2 * 10/2017 Heusser ..... B01F 25/43161
10,077,953 B2 * 9/2018 Matsuda ..... F28F 9/0221
10,571,205 B2 * 2/2020 Higashiiue ..... F28F 9/02
11,788,804 B2 * 10/2023 Bry ..... F28F 9/0226 165/173
2005/0263263 A1 * 12/2005 Merklein ..... F28D 1/05366 165/76
2006/0048923 A1 * 3/2006 Domen ..... F28F 21/006 264/250
2010/0006276 A1 * 1/2010 Cremaschi ..... B21D 53/085 165/173
2011/0120671 A1 * 5/2011 Brauning ..... F28F 9/02 165/96
2013/0087318 A1 * 4/2013 Nakano ..... F28F 1/126 165/181

* cited by examiner

*Primary Examiner* — Steve S Tanenbaum
(74) *Attorney, Agent, or Firm* — LANWAY IPR SERVICES; Chun-Ming Shih

(57) ABSTRACT

A radiator includes a radiator core, two main plates, and a radiating tube module. The main plates are mounted on the radiator core. The radiating tube module includes multiple radiating tubes, and two connecting pieces. Each of the radiating tubes has a first curved corner that is a single-layer tube rim and a second curved corner that is a two-layer laminated tube rim. Each of the connecting pieces has multiple first resting portions and multiple second resting portions. The first curved corner and the second curved corner of each of the radiating tubes are mounted on the first side and the second side of the radiator core respectively. Each of the first resting portions of each of the connecting pieces is mounted on the first curved corner of each of the radiating tubes.

9 Claims, 9 Drawing Sheets

RADIATOR WITH TUBE MODULARIZED DEVICE

BACKGROUND OF THE INVENTION

Field of the Invention

The present invention relates to a radiator or heat sink and, more particularly, to a radiator with a tube modularized device.

Description of the Related Art

A conventional radiator comprises a radiator core, two main plates (or head tubes) mounted on the upper end and the lower end of the radiator core respectively, and multiple radiating tubes mounted on the radiator core and located between the two main plates. The radiating tubes provide a heat dissipation effect to the radiator core. In use, when the two opposite sides (or R-angles) of each of the radiating tubes are subjected to an external force, vibration or stress, each of the radiating tubes is easily broken at the two opposite sides so that water leak is easily produced in the radiator core. Thus, the producer has to install reinforcing plates on each of the radiating tubes to enhance the strength of the radiator core, thereby preventing occurrence of breaking or leaking. However, the producer has to provide and assemble the reinforcing plates on each of the radiating tubes, thereby increasing the cost of fabrication, the working time, and the procedures of assembly. In addition, the reinforcing plates are easily detached from the radiating tubes due to the gravity effect, thereby decreasing the protection function.

BRIEF SUMMARY OF THE INVENTION

In accordance with the present invention, there is provided a radiator comprising a radiator core, two main plates, and a radiating tube module. The radiator core has a first side and a second side. The two main plates are mounted on an upper end and a lower end of the radiator core respectively. Each of the two main plates has a bottom provided with multiple combination portions. The radiating tube module includes multiple radiating tubes, and two connecting pieces. Each of the radiating tubes is a flat tube formed integrally by bending a sheet plate. Each of the radiating tubes has a first curved corner and a second curved corner. The first curved corner is a single-layer seamless R-angle turning surface tube rim. The second curved corner is a two-layer laminated R-angle turning surface tube rim. The first curved corner is opposite to the second curved corner. Each of the two connecting pieces has multiple first resting portions and multiple second resting portions. Each of the first resting portions is a convex face relative to each of the second resting portions. Each of the first resting portions is mounted on the first curved corner of each of the radiating tubes. Each of the second resting portions is a concave face relative to each of the first resting portions. Each of the second resting portions has an inner edge provided with an embedded portion resting on each of the combination portions of each of the two main plates. The first curved corner of each of the radiating tubes is mounted on the first side of the radiator core, and the second curved corner of each of the radiating tubes is mounted on the second side of the radiator core. The two connecting pieces are respectively mounted on an upper end and a lower end of the first side of the radiator core. The two connecting pieces respectively rest on the combination portions of the two main plates. Each of the first resting portions of each of the two connecting pieces is mounted on and covers the first curved corner of each of the radiating tubes. Thus, the first curved corner of each of the radiating tubes and each of the first resting portions of each of the two connecting pieces form an abutting face with a two-layer thickness, and the second curved corner of each of the radiating tubes forms an abutting face with a two-layer thickness, to construct a tube modularized device having an enhanced strength.

According to the primary advantages of the present invention, the radiator provides a heat dissipation effect and also reinforces the strength of each of the radiating tubes, so that each of the radiating tubes has a better stress strength to prevent the root of each of the radiating tubes from being broken due to an external force occurred at the first side and the second side of the radiator core, and to prevent each of the radiating tubes from producing water leakage during the heat radiating process, thereby efficiently enhancing the lifetime of the radiator.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
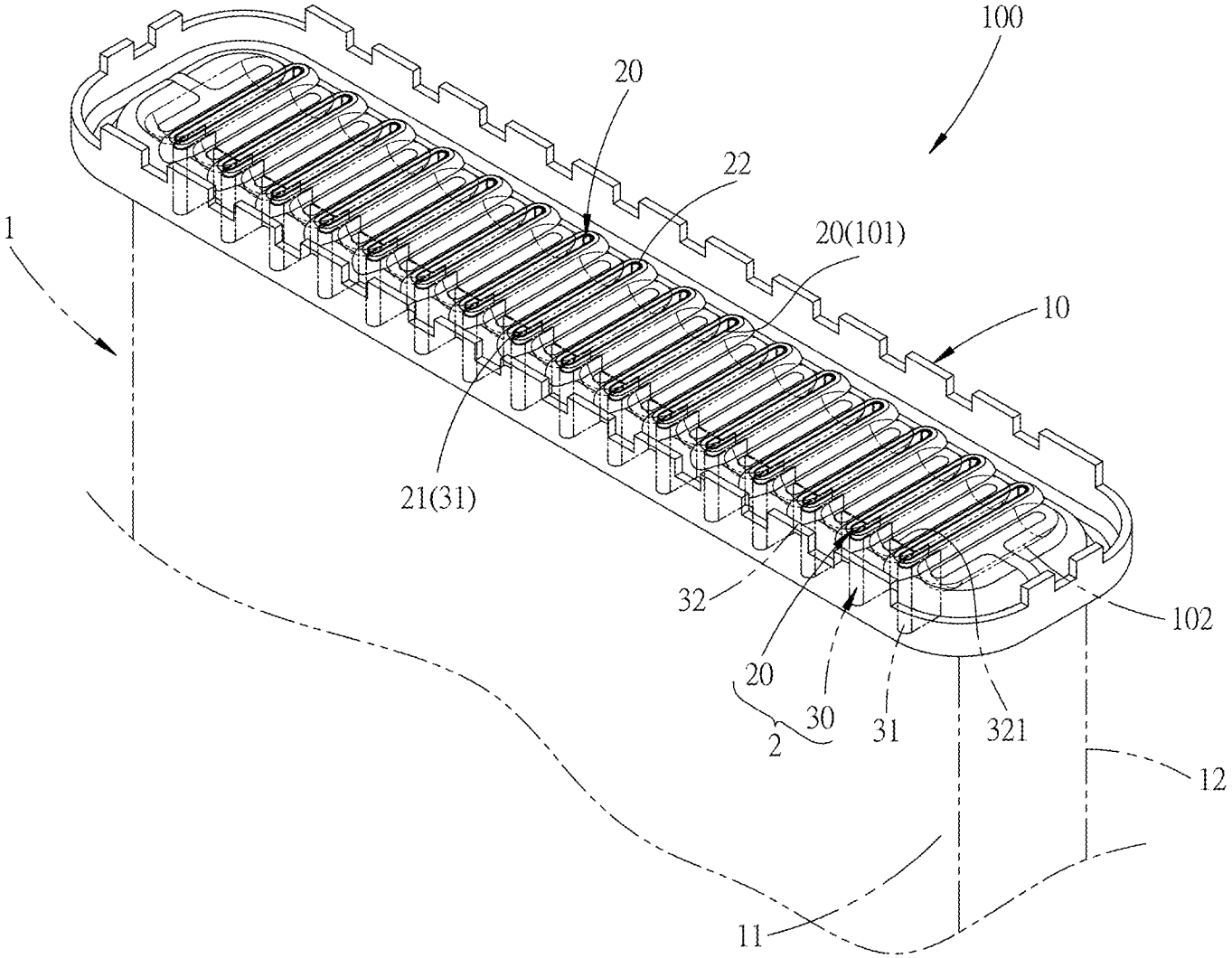
FIG. 1 is a partial perspective view of a radiator in accordance with the preferred embodiment of the present invention.
Figure 2:
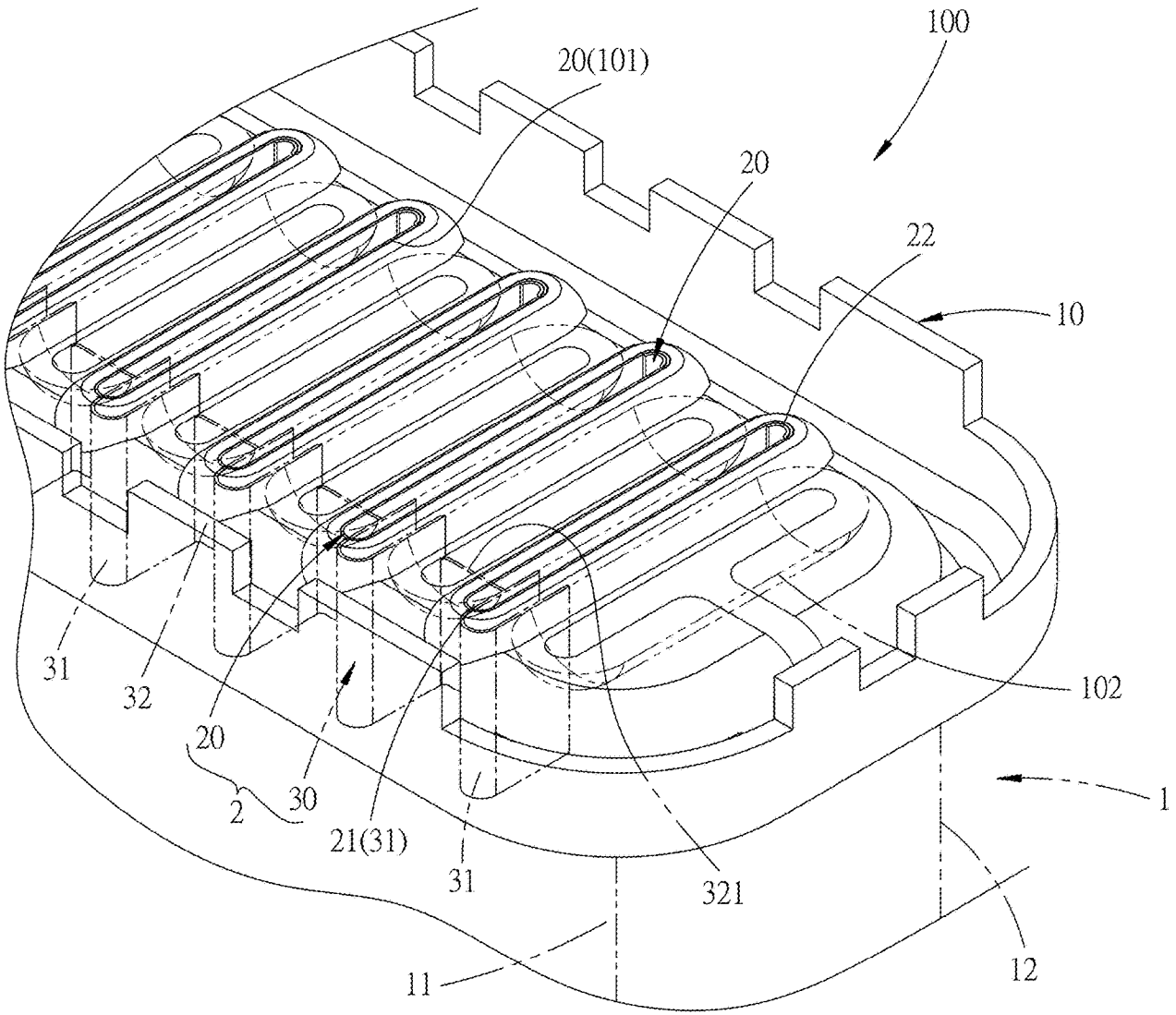
FIG. 2 is a locally enlarged view of the radiator as shown in FIG. 1.
Figure 3:
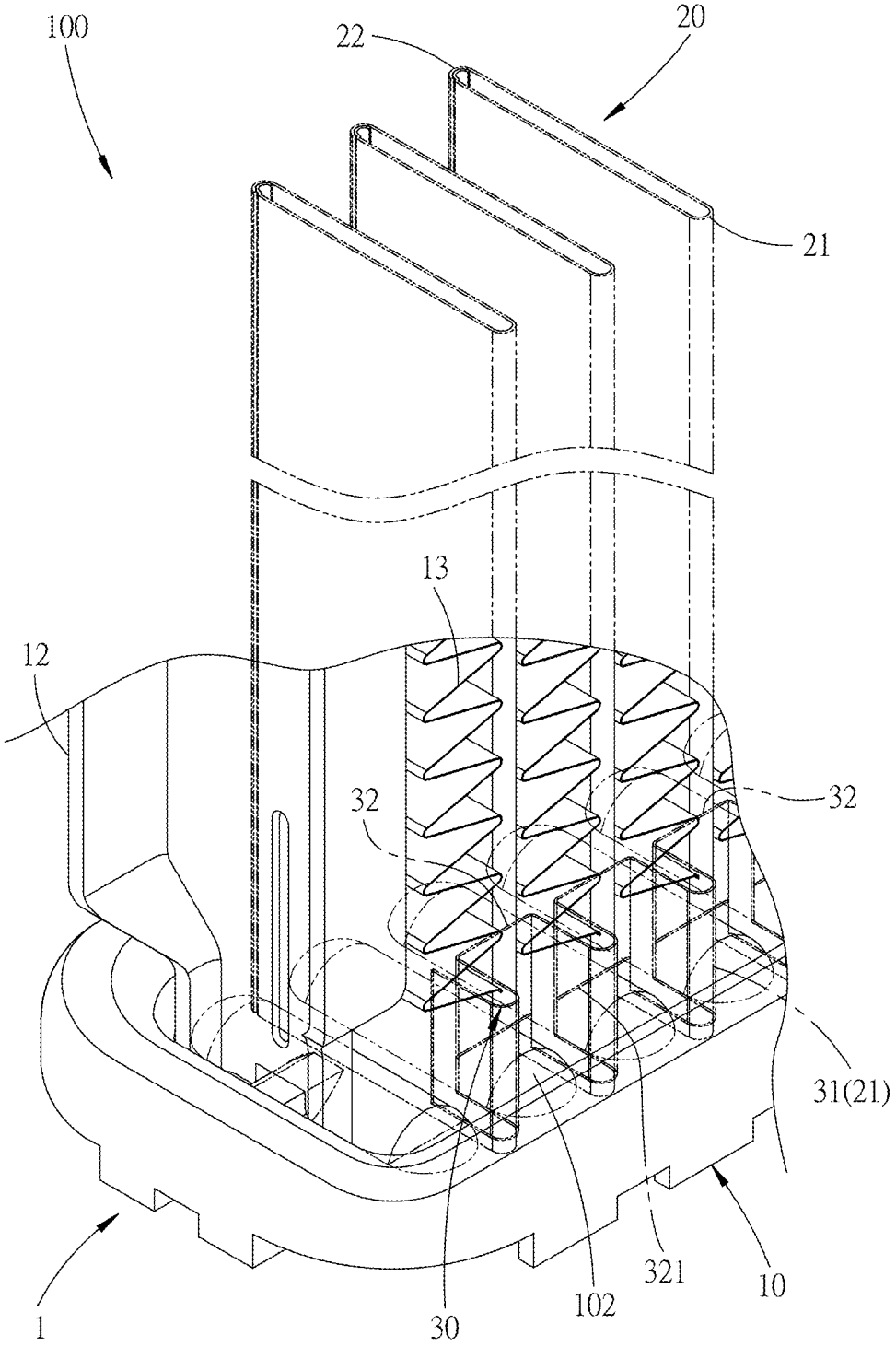
FIG. 3 is another partial perspective view of the radiator in accordance with the preferred embodiment of the present invention.
Figure 4:
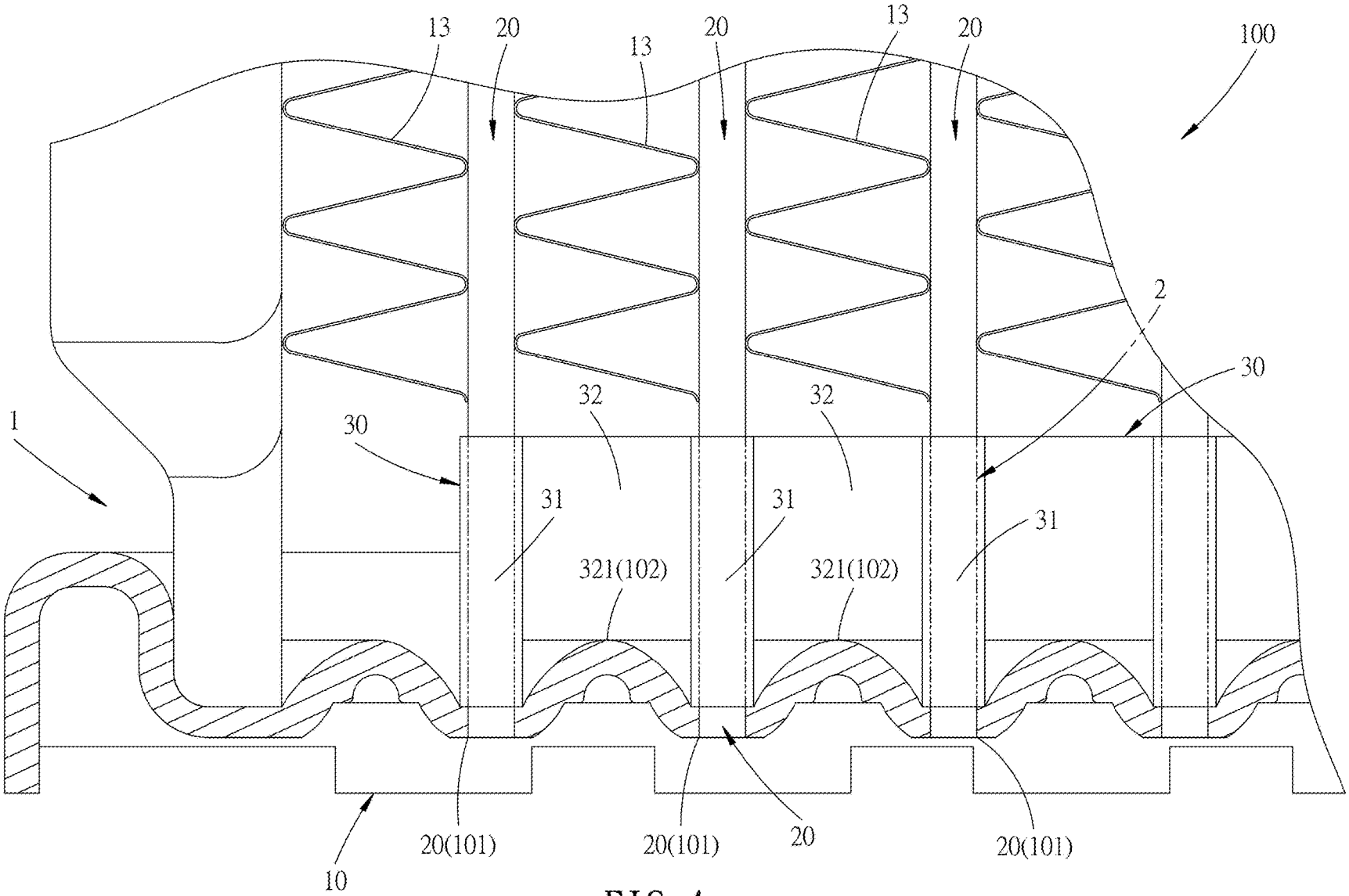
FIG. 4 is a locally enlarged cross-sectional view of the radiator in accordance with the preferred embodiment of the present invention.

Referring to the drawings and initially to FIGS. 1-7, a radiator 100 in accordance with the preferred embodiment of the present invention comprises a radiator core 1, two main plates 10, and a radiating tube module 2.

The radiator core 1 has a first side 11 and a second side 12.

The two main plates 10 are mounted on an upper end and a lower end of the radiator core 1 respectively. Each of the two main plates 10 has a bottom provided with multiple combination portions 102.

The radiating tube module 2 includes multiple radiating tubes 20, and two connecting pieces 30.

Each of the radiating tubes 20 is a hollow flat tube formed integrally by bending a heat dissipation sheet plate made of aluminum. Each of the radiating tubes 20 has a first curved corner 21 and a second curved corner 22. The first curved corner 21 is a single-layer seamless R-angle (or chamfered angle) turning surface tube rim. The second curved corner 22 is a two-layer laminated R-angle turning surface tube rim. The first curved corner 21 is opposite to the second curved corner 22.

Each of the two connecting pieces 30 has multiple first resting portions 31 and multiple second resting portions 32. Each of the first resting portions 31 is a convex face relative to each of the second resting portions 32. Each of the first resting portions 31 is mounted on the first curved corner 21 of each of the radiating tubes 20. Each of the second resting portions 32 is a concave face relative to each of the first resting portions 31. Each of the second resting portions 32 has an inner edge provided with an embedded portion 321 resting on each of the combination portions 102 of each of the two main plates 10.

In assembly, the first curved corner 21 of each of the radiating tubes 20 is mounted on the first side 11 of the radiator core 1, and the second curved corner 22 of each of the radiating tubes 20 is mounted on the second side 12 of the radiator core 1. The two connecting pieces 30 are respectively mounted on an upper end and a lower end of the first side 11 of the radiator core 1. The two connecting pieces 30 respectively rest on the combination portions 102 of the two main plates 10. Each of the first resting portions 31 of each of the two connecting pieces 30 is mounted on and covers the first curved corner 21 of each of the radiating tubes 20. Thus, the first curved corner 21 of each of the radiating tubes 20 and each of the first resting portions 31 of each of the two connecting pieces 30 form an abutting face (or a reinforced face) with a two-layer thickness, and the second curved corner 22 of each of the radiating tubes 20 forms an abutting face with a two-layer thickness, to construct a tube modularized device having an enhanced strength.

In the preferred embodiment of the present invention, the first resting portions 31 and the second resting portions 32 of each of the two connecting pieces 30 construct multiple independent reinforced plates and are connected to form a single reinforcement. Each of the first resting portions 31 of each of the two connecting pieces 30 is mounted on the first curved corner 21 of each of the radiating tubes 20, to form the abutting face with a two-layer thickness.

In the preferred embodiment of the present invention, the radiating tubes 20 are arranged to form at least one row.

In the preferred embodiment of the present invention, the first curved corner 21 of each of the radiating tubes 20 is arranged toward the first side 11 of the radiator core 1, the second curved corner 22 of each of the radiating tubes 20 is arranged toward the second side 12 of the radiator core 1, and the two connecting pieces 30 are arranged toward the first side 11 of the radiator core 1.

In the preferred embodiment of the present invention, each of the first resting portions 31 of each of the two connecting pieces 30 is U-shaped in cross-section and presents a relative convex face relative to each of the second resting portions 32, and each of the second resting portions 32 of each of the two connecting pieces 30 is a straight line in cross-section and presents a relative concave face relative to each of the first resting portions 31.

In the preferred embodiment of the present invention, each of the first resting portions 31 of each of the two connecting pieces 30 has a shape corresponding to that of the first curved corner 21 of each of the radiating tubes 20.

In the preferred embodiment of the present invention, the radiator core 1 includes multiple fins 13 located between the radiating tubes 20, and each of the second resting portions 32 of each of the two connecting pieces 30 is located between two of the radiating tubes 20 and forms a planar section arranged above the fins 13 of the radiator core 1.

In the preferred embodiment of the present invention, the embedded portion 321 of each of the second resting portions 32 of each of the two connecting pieces 30 forms a recessed flat section.

In the preferred embodiment of the present invention, each of the second resting portions 32 of each of the two connecting pieces 30 has a width equal to a distance between two of the radiating tubes 20.

In the preferred embodiment of the present invention, the two main plates 10 are secured to the upper end and the lower end of the radiator core 1 by soldering. Each of the two main plates 10 is provided with multiple tube slots 101. The combination portions 102 are located at a connection of each of the two main plates 10 and the radiator core 1. The fins 13 are located under the combination portions 102.

In the preferred embodiment of the present invention, the combination portions 102 are projections spaced from each other. The combination portions 102 and the tube slots 101 of each of the two main plates 10 are arranged alternatingly.

In the preferred embodiment of the present invention, the radiating tubes 20 align with and are inserted into the tube slots 101 of each of the two main plates 10.

Figure 5:
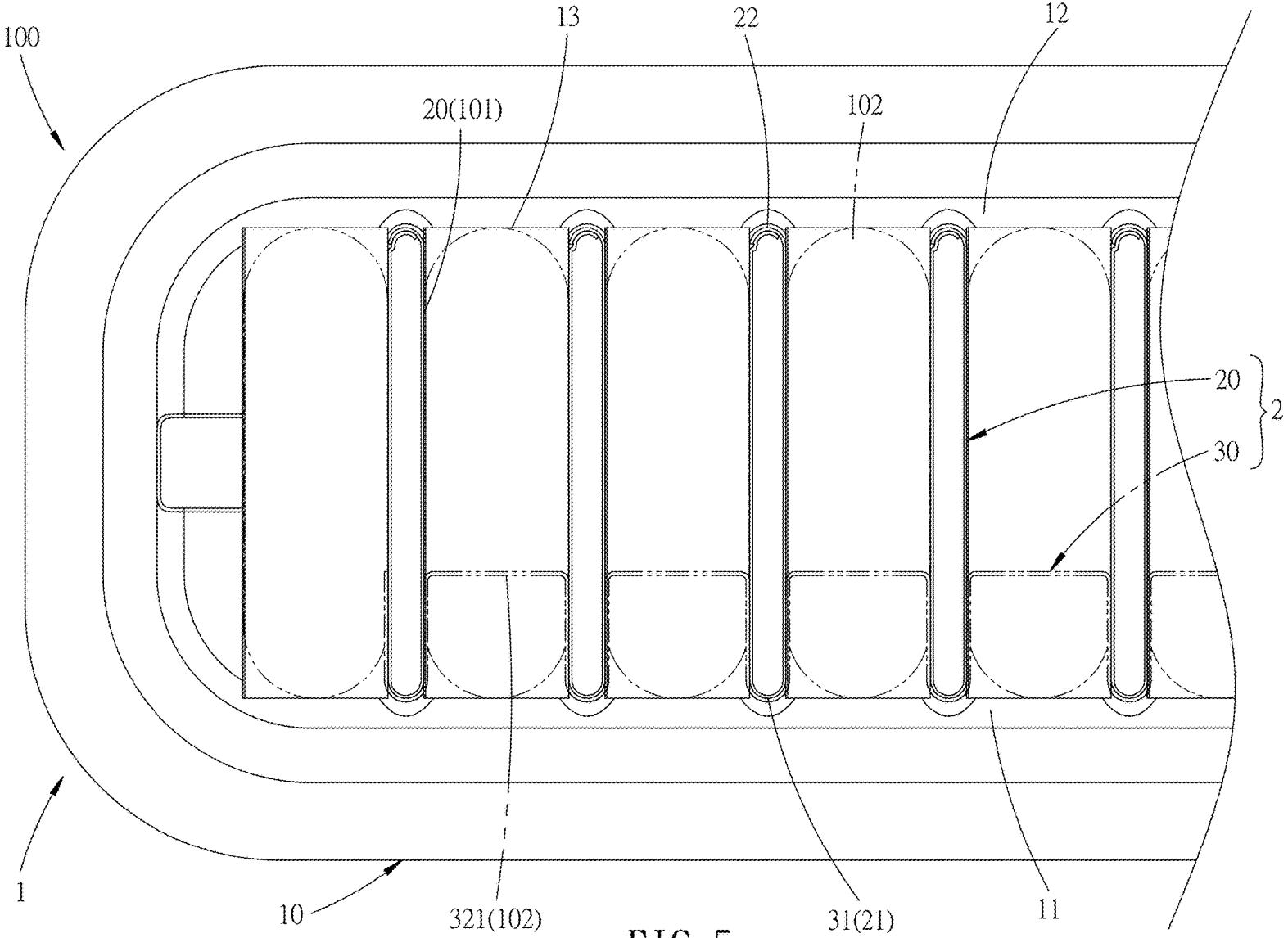
FIG. 5 is a locally enlarged top view of the radiator in accordance with the preferred embodiment of the present invention.
Figure 6:
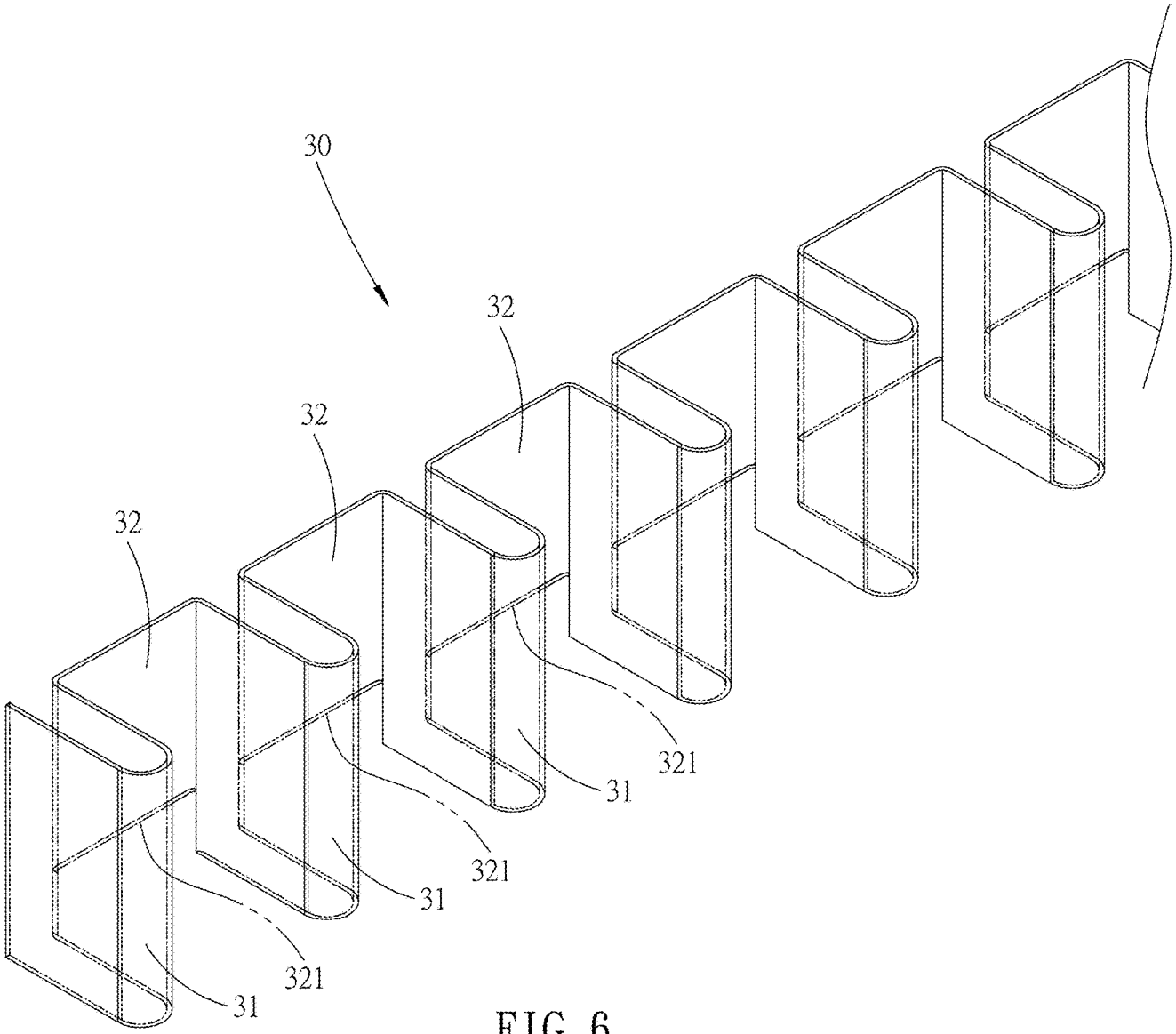
FIG. 6 is a perspective view of a connecting piece of the radiator in accordance with the preferred embodiment of the present invention.
Figure 7:
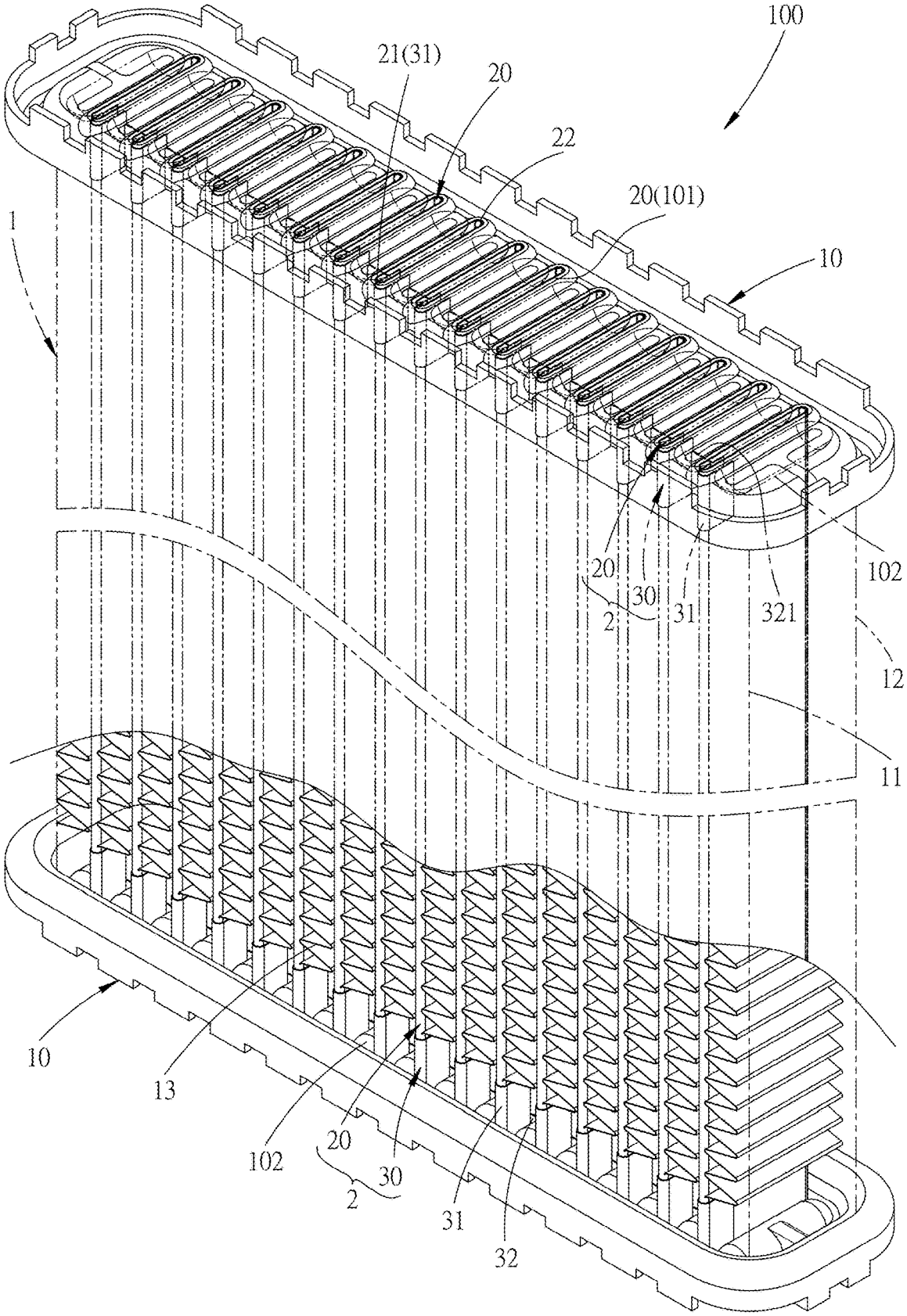
FIG. 7 is a schematic perspective view of the radiator in accordance with the preferred embodiment of the present invention.

In the preferred embodiment of the present invention, each of the radiating tubes 20 has two arcuate ends laminating each other to form the second curved corner 22 as shown in FIG. 5. Thus, the second curved corner 22 of each of the radiating tubes 20 is thickened and has a two-layer thickness. In contrast, the first curved corner 21 of each of the radiating tubes 20 only has a one-layer thickness. The first curved corner 21 of each of the radiating tubes 20 is a seamless chamfered angle and has an arcuate shape.

In the preferred embodiment of the present invention, the two arcuate ends of each of the radiating tubes 20 are laminated by brazing.

In the preferred embodiment of the present invention, the embedded portion 321 of each of the second resting portions 32 is affixed to each of the combination portions 102 of each of the two main plates 10 by soldering, thereby forming a secure and steady connection.

Accordingly, the first curved corner 21 of each of the radiating tubes 20 and each of the first resting portions 31 of each of the two connecting pieces 30 form an abutting face with a two-layer thickness at the first side 11 of the radiator core 1, and the second curved corner 22 of each of the radiating tubes 20 also forms an abutting face with a two-layer thickness at the second side 12 of the radiator core 1, to construct a tube modularized device having an enhanced strength, so that each of the radiating tubes 20 has a two-layer thickness at the first curved corner 21 and the second curved corner 22 to reinforce the structural strength of the first side 11 and the second side 12 of the radiator core 1. Thus, the radiator 100 provides a heat dissipation effect and also reinforces the strength of each of the radiating tubes 20, so that each of the radiating tubes 20 has a better stress strength to prevent the root of each of the radiating tubes 20 from being broken due to an external force occurred at the first side 11 and the second side 12 of the radiator core 1, and to prevent each of the radiating tubes 20 from producing water leakage during the heat radiating process, thereby efficiently enhancing the lifetime of the radiator 100.

Figure 8:
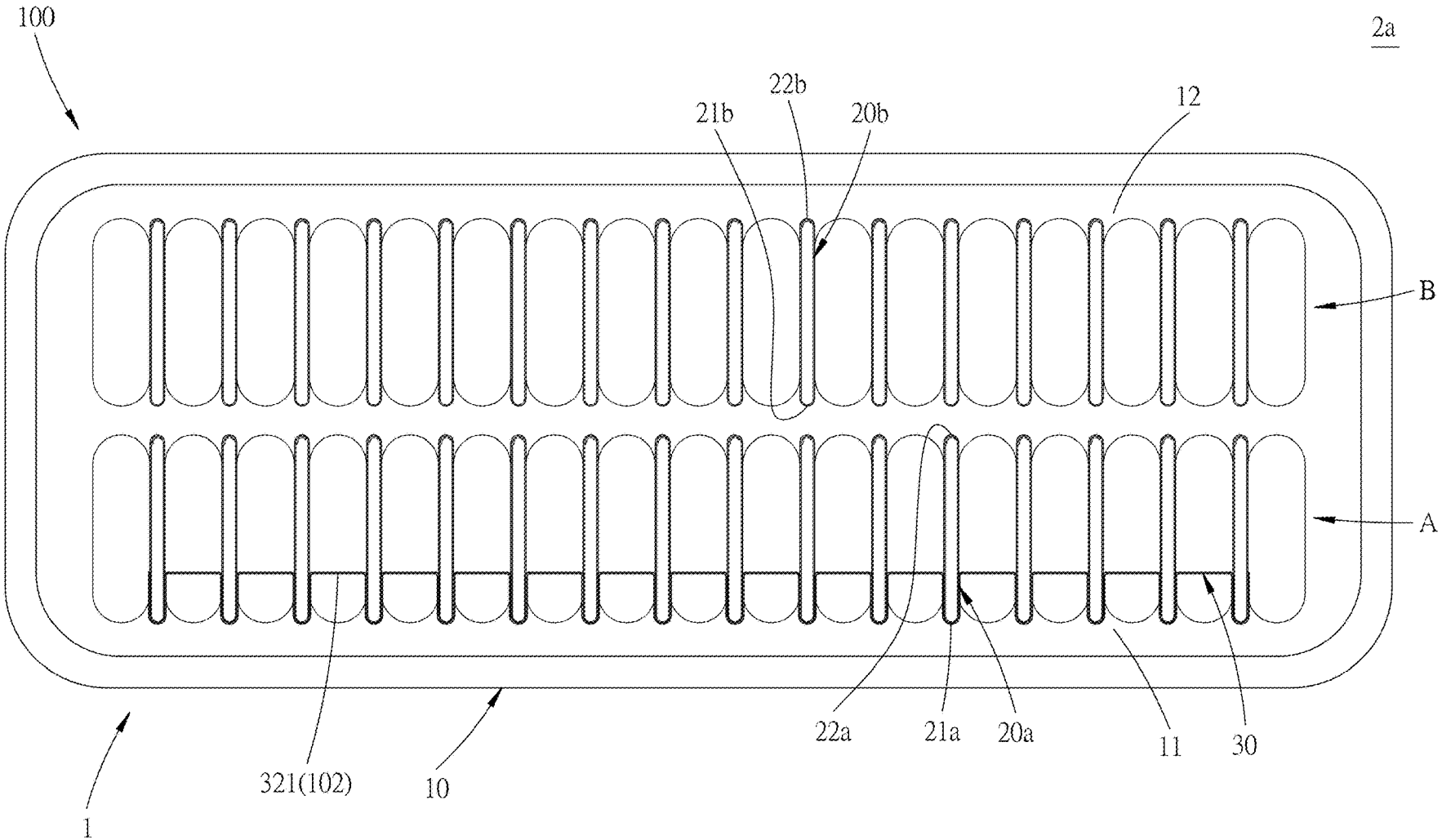
FIG. 8 is a top view of a radiator in accordance with another preferred embodiment of the present invention.

Referring to FIG. 8 with reference to FIGS. 1-7, the radiating tube module 2*a* includes a first row A, a second row B, and two connecting pieces 30. The first row A includes multiple radiating tubes 20*a*. Each of the radiating tubes 20*a* has a first curved corner 21*a* and a second curved corner 22*a*. The first curved corner 21*a* is a single-layer seamless R-angle turning surface tube rim. The second curved corner 22*a* is a two-layer laminated R-angle turning surface tube rim. The second row B includes multiple radiating tubes 20*b*. Each of the radiating tubes 20*b* has a first curved corner 21*b* and a second curved corner 22*b*. The first curved corner 21*b* is a single-layer seamless R-angle turning surface tube rim. The second curved corner 22*b* is a two-layer laminated R-angle turning surface tube rim. In assembly, the first curved corner 21*a* of each of the radiating tubes 20*a* of the first row A is mounted on the first side 11 of the radiator core 1, and the second curved corner 22*b* of each of the radiating tubes 20*b* of the second row B is mounted on the second side 12 of the radiator core 1. Thus, the second curved corner 22*b* of each of the radiating tubes 20*b* of the second row B is distant from the first curved corner 21*a* of each of the radiating tubes 20*a* of the first row A. The two connecting pieces 30 are respectively mounted on an upper end and a lower end of the first side 11 of the radiator core 1. Each of the first resting portions 31 of each of the two connecting pieces 30 is mounted on and covers the first curved corner 21*a* of each of the radiating tubes 20*a* of the first row A. Thus, the first curved corner 21*a* of each of the radiating tubes 20*a* of the first row A and each of the first resting portions 31 of each of the two connecting pieces 30 form an abutting face (or a reinforced face) with a two-layer thickness, and the second curved corner 22*b* of each of the radiating tubes 20*b* of the second row B forms an abutting face with a two-layer thickness, to construct a tube modularized device having an enhanced strength.

Figure 9:
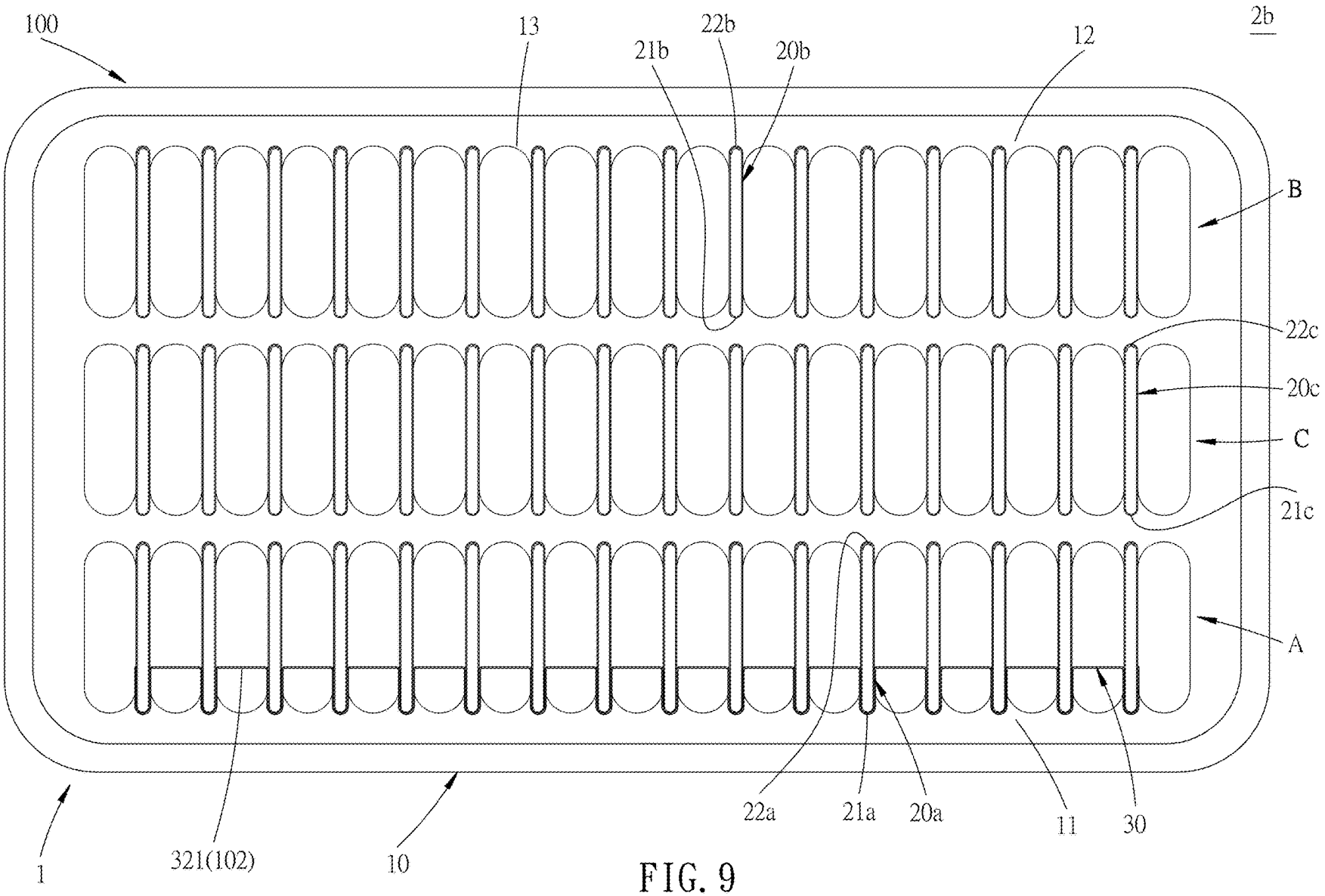
FIG. 9 is a top view of a radiator in accordance with another preferred embodiment of the present invention.

Referring to FIG. 9 with reference to FIG. 8, the radiating tube module 2*a* further includes a third row C arranged between the first row A and the second row B. The third row C is directed toward a direction the same as that of the first row A and the second row B. The third row C includes multiple radiating tubes 20*c*. Each of the radiating tubes 20*c* has a first curved corner 21*c* and a second curved corner 22*c*. The first curved corner 21*c* is a single-layer seamless R-angle turning surface tube rim. The second curved corner 22*c* is a two-layer laminated R-angle turning surface tube rim. The first curved corner 21*c* of each of the radiating tubes 20*c* of the third row C is adjacent to the second curved corner 22*a* of each of the radiating tubes 20*a* of the first row A, and the second curved corner 22*c* of each of the radiating tubes 20*c* of the third row C is adjacent to the first curved corner 21*b* of each of the radiating tubes 20*b* of the second row B.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A radiator comprising:

a radiator core, two main plates, and a radiating tube module;

wherein:

the radiator core has a first side and a second side;

the two main plates are mounted on an upper end and a lower end of the radiator core respectively;

each of the two main plates has a bottom provided with multiple combination portions;

the radiating tube module includes multiple radiating tubes, and two connecting pieces;

each of the radiating tubes is a flat tube formed integrally by bending a sheet plate;

each of the radiating tubes has a first curved corner and a second curved corner;

the first curved corner is a single-layer seamless R-angle turning surface tube rim;

the second curved corner is a two-layer laminated R-angle turning surface tube rim;

the first curved corner is opposite to the second curved corner;

each of the two connecting pieces has multiple first resting portions and multiple second resting portions;

each of the first resting portions is a convex face relative to each of the second resting portions;

each of the first resting portions is mounted on the first curved corner of each of the radiating tubes;

each of the second resting portions is a concave face relative to each of the first resting portions;

each of the second resting portions has an inner edge provided with an embedded portion resting on each of the combination portions of each of the two main plates;

the first curved corner of each of the radiating tubes is mounted on the first side of the radiator core;

the second curved corner of each of the radiating tubes is mounted on the second side of the radiator core;

the two connecting pieces are respectively mounted on an upper end and a lower end of the first side of the radiator core;

the two connecting pieces respectively rest on the combination portions of the two main plates;

each of the first resting portions of each of the two connecting pieces is mounted on and covers the first curved corner of each of the radiating tubes;

the first curved corner of each of the radiating tubes and each of the first resting portions of each of the two connecting pieces form an abutting face with a two-layer thickness, and the second curved corner of each of the radiating tubes forms an abutting face with a two-layer thickness, to construct a tube modularized device having an enhanced strength.

2. The radiator as claimed in claim 1, wherein:

the first resting portions and the second resting portions of each of the two connecting pieces construct multiple independent reinforced plates and are connected to form a single reinforcement;

each of the first resting portions of each of the two connecting pieces is mounted on the first curved corner of each of the radiating tubes, to form the abutting face with a two-layer thickness.

3. The radiator as claimed in claim 1, wherein the radiating tubes are arranged to form at least one row.

4. The radiator as claimed in claim 1, wherein each of the first resting portions of each of the two connecting pieces is U-shaped in cross-section and presents a relative convex face relative to each of the second resting portions, and each of the second resting portions of each of the two connecting pieces is a straight line in cross-section and presents a relative concave face relative to each of the first resting portions.

5. The radiator as claimed in claim 1, wherein the embedded portion of each of the second resting portions of each of the two connecting pieces forms a recessed flat section.

6. The radiator as claimed in claim 1, wherein each of the second resting portions of each of the two connecting pieces has a width equal to a distance between two of the radiating tubes.

7. The radiator as claimed in claim 1, wherein the first curved corner of each of the radiating tubes is arranged toward the first side of the radiator core, the second curved corner of each of the radiating tubes is arranged toward the second side of the radiator core, and the two connecting pieces are arranged toward the first side of the radiator core.

8. The radiator as claimed in claim 7, wherein each of the first resting portions of each of the two connecting pieces has a shape corresponding to that of the first curved corner of each of the radiating tubes.

9. The radiator as claimed in claim 7, wherein the radiator core includes multiple fins located between the radiating tubes, and each of the second resting portions of each of the two connecting pieces is located between two of the radiating tubes and forms a planar section arranged above the fins of the radiator core.

* * * * *